US006389855B2

(12) United States Patent
Renz et al.

(10) Patent No.: US 6,389,855 B2
(45) **Date of Patent: *May 21, 2002**

(54) LOCKING DEVICE FOR A DOOR, WINDOW OR THE LIKE

(75) Inventors: Walter Renz, Ditzingen; Wolfgang Röger, Stuttgart; Thomas Henzler, Ostfildern, all of (DE)

(73) Assignee: Gretsch-Unitas GmbH Baubeschlage, Ditzingen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/824,867

(22) Filed: Mar. 26, 1997

(30) Foreign Application Priority Data

Mar. 26, 1996 (DE) ..... 296 05 517 U

(51) Int. Cl.[7] ..... E05B 59/04; E05B 63/14

(52) U.S. Cl. ..... 70/107; 70/109; 70/110; 70/143; 292/35; 292/36; 292/335

(58) Field of Search ..... 292/335, 34–36, 292/41; 70/107–111, 143

(56) References Cited

U.S. PATENT DOCUMENTS

| | | | | | |
|---|---|---|---|---|---|
| 1,302,873 | A | * | 5/1919 | Stiff | 292/335 |
| 1,306,560 | A | * | 6/1919 | Page | 292/335 |
| 1,591,476 | A | * | 7/1926 | Dorneth | 292/335 |
| 1,652,616 | A | * | 12/1927 | Drouin | 292/335 |
| 2,162,929 | A | * | 6/1939 | Armstrong | 292/335 |
| 2,241,872 | A | * | 5/1941 | Van Note | 292/335 |
| 2,710,216 | A | * | 6/1955 | Eichacker | 292/335 |
| 3,582,122 | A | * | 6/1971 | Foster et al. | 292/335 |
| 3,677,043 | A | * | 7/1972 | Cox | 292/335 X |
| 3,912,309 | A | * | 10/1975 | Fischer et al. | 292/335 X |
| 4,534,192 | A | * | 8/1985 | Harshbarger et al. | 292/335 X |
| 4,854,619 | A | * | 8/1989 | Nakauchi | 292/335 |
| 4,962,653 | A | * | 10/1990 | Kaup | 70/108 X |
| 5,495,731 | A | * | 3/1996 | Riznik | 70/108 |
| 5,531,492 | A | * | 7/1996 | Raskevicius | 292/335 |
| 5,878,605 | A | * | 3/1999 | Renz | 70/107 |
| 5,896,763 | A | * | 4/1999 | Dinkelborg et al. | 70/108 X |

FOREIGN PATENT DOCUMENTS

| | | | | |
|---|---|---|---|---|
| AU | 1357 | * | 4/1926 | 292/335 |
| DE | 3505379 C1 | | 10/1986 | |
| DE | 4110557 | * | 10/1992 | 70/107 |
| EP | 0431369 A2 | | 6/1991 | |
| FR | 630038 | * | 11/1927 | 292/335 |
| FR | 1016504 | * | 11/1952 | 292/335 |
| GB | 341429 | * | 7/1929 | 292/335 |
| GB | 573165 | * | 11/1945 | 292/335 |
| GB | 612094 | * | 11/1948 | 292/335 |

* cited by examiner

*Primary Examiner*—Lloyd A. Gall
(74) *Attorney, Agent, or Firm*—Jones, Tullar & Cooper, P.C.

(57) ABSTRACT

In a locking device for a door, window or the like, having a main lock box, at least one supplementary lock box, and at least one drive rod connecting the supplementary lock boxes to the main lock box, better resistance to break-ins is attained in that the supplementary lock box has a latch bolt that can be retracted freely into the latching position, wherein the latch bolt is displaceable by a spring and/or by a gear past the normal latching position into its locking position.

23 Claims, 17 Drawing Sheets

LOCKING DEVICE FOR A DOOR, WINDOW OR THE LIKE

FIELD OF THE INVENTION

The present invention relates to a locking device for a door, window or the like, having a main lock box, at least one supplementary lock box, and at least one drive rod connecting the supplementary lock boxes to the main lock box.

BACKGROUND OF THE INVENTION

From German Patent DE 35 05 379 C1, a drive rod lock has been disclosed that is connected via a drive rod to a middle lock. In other words, this drive rod connects the two latches of the two locks. In this way, a door can be connected to the edge plate in the door frame not only in the middle but also in the region of its corners. When the door is closed, the latches are pushed inward along the edge plate, so that the door can assume its closing position. For opening the door, the latch of the middle lock is actuated and retracted via a door handle or a lock cylinder; this motion is transmitted via the drive rod via the latch of the drive rod lock, thus retracting this latch as well. A disadvantage here is that when the latch is pushed inward, the drive rod is also always moved. This makes the latch sluggish and causes functional problems.

European Patent Disclosure EP 431 369 A2 discloses a mortise lock with a latch bolt. This latch bolt has the task, besides that of a conventional bolt, of additionally locking the door, which is accomplished in that the latch bolt after the door is closed changes over automatically from a latching position to a locking position, in which it is pushed farther out of the mortise lock than in the latching position and thus engages far inside the edge plate in the door frame. As a rule, such a latch bolt can no longer be retracted by inserting some tool into the slit between the door and the door frame. A door with this kind of latch bolt is automatically locked after being closed.

OBJECT AND SUMMARY OF THE INVENTION

An object of the present invention is to furnish a locking device with supplementary lock boxes with which the door offers better resistance to break-ins and moreover to improve the latch function.

According to the present invention, this object is attained in that in the locking device of the type referred to at the outset, the supplementary lock box has a latch bolt that can be retracted freely; the latch bolt is displaceable by a spring and/or by a gear past the normal latching position into its locking position.

With the locking device according to the present invention, the advantage is attained that the door can be held outside the middle, or in other words at least in the region of one corner, via the latch bolt and can also be locked thereby. If a door equipped with the locking device according to the present invention is swung shut, then first the latch bolt is retracted via the edge plate in the door frame, thus making it possible for the door to be closed. If the door is in the closed position, the latch bolt is pushed out of the supplementary lock box and moves past its latching position into a locking position. In that position, the latch bolt cannot be pushed back into the gap between the door and the door frame, for instance, by inserting some flat tool. A door locked in this way offers high resistance to break-ins.

It is especially worth noting that the latch bolt, when the door is open, is held in the latching position by a blocking element, so that the door can easily be closed. Not until the door assumes its closed position does the blocking element release the latch bolt, so that the latch bolt can move past the latching position further by approximately 10 mm to 15 mm out of the supplementary lock box and can engage the edge plate in the door frame. The release of the latch bolt by the blocking element takes place automatically whenever the door assumes its closing position, since then the blocking element is forced by the edge plate in the door frame into the release position. In other words, the automatic movement outward of the latch bolt is tripped by the edge plate.

In a further feature it is provided that the blocking element is supported pivotably in the latch bolt in a normal plane to the pivot axis of the door. In other words, the blocking element has a pivot axis parallel to the pivot axis of the door, so that when it meets the edge plate it can deflect. In the position of repose, the blocking element protrudes part way past the contour of the latch bolt.

Preferably, the blocking element is forced in the projection direction via a spring-loaded lever. From this projection direction, in which the blocking element protrudes beyond the contour of the latch bolt, the blocking element can be pushed counter to the force of the spring-loaded lever into a position inside the contour of the latch bolt and is thereby rendered inoperative.

In one exemplary embodiment it is accordingly provided that via the blocking element, the latch bolt is forced into the latching and locking position. The spring-loaded lever that forces the blocking element in the projection direction also brings about the projection of the latch bolt into its latching position when the door is open and into its locking position when the door is closed.

The latch bolt, on its side opposite the contact incline and in the region of the latch tail, preferably has a protrusion which is engaged by a latch restoring lever. Via this latch restoring lever, the latch bolt is retracted either out of its locking position or out of its latching position, to allow the door to be opened. The latch restoring lever is connected to the drive rod in such a way that on actuation of the drive rod it is carried along by the drive rod into the reverse closing position. On being shifted into this reverse closing position, the latch restoring lever pulls the latch bolt all the way into the supplementary lock box. Via the drive rod, a plurality of supplementary lock boxes can be connected to the main lock box, so that the individual latch bolts of the supplementary lock boxes are thrust synchronously into the respective lock boxes via the drive rod. The use of a plurality of lock boxes over the height of the door also prevents warping of the door and further reduces the danger of break-ins.

Preferably, on closure of the door and pushing in of the latch bolt, the latch restoring lever is pivoted by the latch bolt and decoupled from the drive rod. Accordingly, on closing of the door only the latch bolt is thrust inward but the drive rod is not actuated.

Preferably, the latch restoring lever is pivotable about an axis at right angles to the door leaf. In this way, the latch restoring lever converts the shear force, which on displacement of the drive rod extends in a direction parallel to the pivot axis of the door, into a shear force that is orthogonal to it and is located at the plane of the door leaf, and with this latter shear force the latch bolt can be retracted into the supplementary lock box.

In accordance with a preferred exemplary embodiment, the latch bolt is engaged by a latch blocking lever, which when the latch bolt has been pushed all the way out locks the latch bolt in the locking position. This latch blocking lever prevents the latch bolt, located in the locking position, from being retractable into the supplementary lock box, for instance via a tool inserted between the door and the door frame, even if the door frame is damaged, exposing the latch bolt.

A further feature provides that the latch blocking lever in the locking position engages the latch bolt, or a protrusion of the latch bolt from behind with a latch blocking edge. As soon as the latch bolt assumes its locking position, the latch blocking lever is shifted in such a way that its latch blocking edge secures the latch bolt in the locking position. Displacement of the latch bolt can occur only whenever the engagement from behind of the latch blocking edge of the latch blocking lever is undone.

An especially preferred exemplary embodiment contemplates that the latch restoring lever has a pawl, which upon actuation of the latch restoring lever by means of the drive rod lifts the latch blocking lever out of its position that locks the latch bolt and releases the latch bolt for retraction.

Accordingly, if the latch bolt is in its locking position and is secured in that position via the latch blocking lever, then by actuation of the drive rod the latch restoring lever, with which the latch bolt is retracted into the supplementary lock box, and the latch blocking lever can be lifted out of the blocking position of the latch blocking lever before the latch bolt is retracted.

The latch blocking lever may be supported pivotably about an axis perpendicular to the door leaf. Moreover, the latch blocking lever is connected to a spring, in particular a torsion spring, that forces it into the locking position. As a consequence, when the latch bolt is projected all the way, the latch blocking lever automatically assumes the locking position and locks the latch bolt against being retracted.

The noted object is also attained with the variant of the present invention, which may also be a further feature of the aforementioned present invention, in which the locking device is further developed such that the supplementary lock box has a latch bolt, and the latch bolt can be moved from a latching position into a locking position via the first drive rod and back, and via a second drive rod from the latching position into a retracted position.

In this locking device according to the present invention, the latch bolt after the door is closed is shifted via the first drive rod into the locking position, thereby securing the door against a break-in. From this position, the latch bolt can again be brought back into the latching position by actuation of the first drive rod. Moreover, the latch bolt can be retracted all the way into the supplementary lock box via the second drive rod, so that the door can be opened. It is considered advantageous that upon actuation of the first drive rod, the latch bolt will certainly engage the associated edge plate and lock the door. The latch bolt is reinforced in this task by a spring that acts in the projection direction.

Moreover, via the drive rod, the stroke of the latch bolt on moving outward to the locking position can be lengthened, which achieves even greater protection against break-ins.

A preferred exemplary embodiment of the present invention contemplates that via the first drive rod, the latch bolt is not only lockable but also retractable all the way into the supplementary lock box. This has the advantage that the latch bolt can be displaced via a single drive rod over the entire working range.

Advantageously, the latch bolt is retractable via the second drive rod only whenever the latch bolt is in the latching position. If the latch bolt is pushed all the way out, or in other words is in the locking position, then the latch bolt is uncoupled from the second drive rod; in other words, the second drive rod cannot transmit the adjusting forces to the latch bolt.

Advantageously, the first drive rod is operatively connected to a lock cylinder of the main lock box. Via this lock cylinder, the latch bolt can accordingly be moved both into the open position and into the locking position. If the latch bolt is in the locking position, then in this exemplary embodiment the door can be unlocked and opened solely via the lock cylinder. If the latch bolt is in the latching position, then it can be drawn inward into the lock box either via a handle or via the lock cylinder. It is understood that instead of the door handle and lock cylinder type of lock, a doorknob lock, of the kind encountered as a rule in the United States, may be provided. One exemplary embodiment contemplates that the latch bolt is connected via toothing, in particular a rack that meshes with a split toothed ring of a drive wheel. This drive wheel has the function of moving the latch bolt between its locking position and its fully retracted position. The latch bolt and the drive wheel may form a step-up or step-down gear.

Preferably, the end of the first drive rod toward the supplementary lock box is connected to the drive wheel via two tabs. The drive wheel is driven via the first tab. Both tabs are pivotably fixed both to the end of the drive rod and to the drive wheel. The first tab drives the drive wheel in different directions and with a journal engages an oblong slot in the drive wheel, and the second tab engages a slide that is connected to the drive wheel. A journal is provided on the slide, which engages an oblong slot provided on the end of the second tab remote from the drive rod. In this way, a decoupling—that is, idle travel of the drive wheel—from the first drive rod is made possible, so that when the latch bolt is retracted—that is, the door has been shut—into the supplementary lock box the drive wheel is indeed moved along but the first drive rod remains in repose, since because of the oblong slots some idle travel has been created for the first drive rod on the drive wheel.

Preferably, the end of the second drive rod toward the supplementary lock box engages the drive wheel via a slide pivotably secured to the drive wheel. Via this slide, the drive wheel can accordingly be moved in the opening direction, thus retracting the latch bolt.

A preferred embodiment contemplates that the slide can be swiveled out of operative range of the second drive rod for the second tab. This is the case whenever the latch bolt has been displaced into its locking position via the first drive rod, and via the two tabs the drive wheel has been rotated in the closing direction and in the process the slide has been swiveled out of operative range of the second drive rod. In that case, the drive wheel can no longer be addressed via the second drive rod, since the operative connection has been interrupted by the outward swiveling of the slide out of the operative range. Only via the first drive rod can the drive wheel be displaced back into the latching position, in which the operative connection between the second drive rod, the slide and the drive wheel is then re-established.

A decoupling of a plurality of latch bolts is attained in that the latch bolt is retracted upon closure of the door and is out of operative communication with the two drive rods. This embodiment has the advantage that by pushing a tool into the gap between the door and the door frame, for instance, the latch bolt in the latching position can still be retracted, but the other latch bolts are not automatically retracted with it. In other words, the decoupling further increases the protection against break-ins.

In an exemplary embodiment of the present invention it is contemplated that the latch bolt is embodied as a swivel latch bolt. In this embodiment, the latch bolt is not pushed linearly out of the lock box but instead is rotated about a pivot axis and emerges from the lock box in the course of the rotary motion. This swivel latch bolt is swivelable in a manner corresponding to a swivel bolt.

The latch bolt is preferably retractable electromagnetically. In this way, the door can be opened with an electric door opener, for instance, in that all the latch bolts are retracted simultaneously in a known manner via a magnet.

Preferably, the main lock box has a latch bolt, a bolt and/or a latch. In a further feature of the present invention, the main lock box may be embodied as a panic lock.

Further advantages, characteristics and details will become apparent from the claims and the ensuing specification, in which especially preferred embodiments are described in detail in conjunction with the drawing. The characteristics shown in the drawing and those recited in the specification and claims may be essential to the present invention either individually or in any arbitrary combination with one another.

DESCRIPTION OF THE PREFERRED EMBODIMENTS

Figure 1:
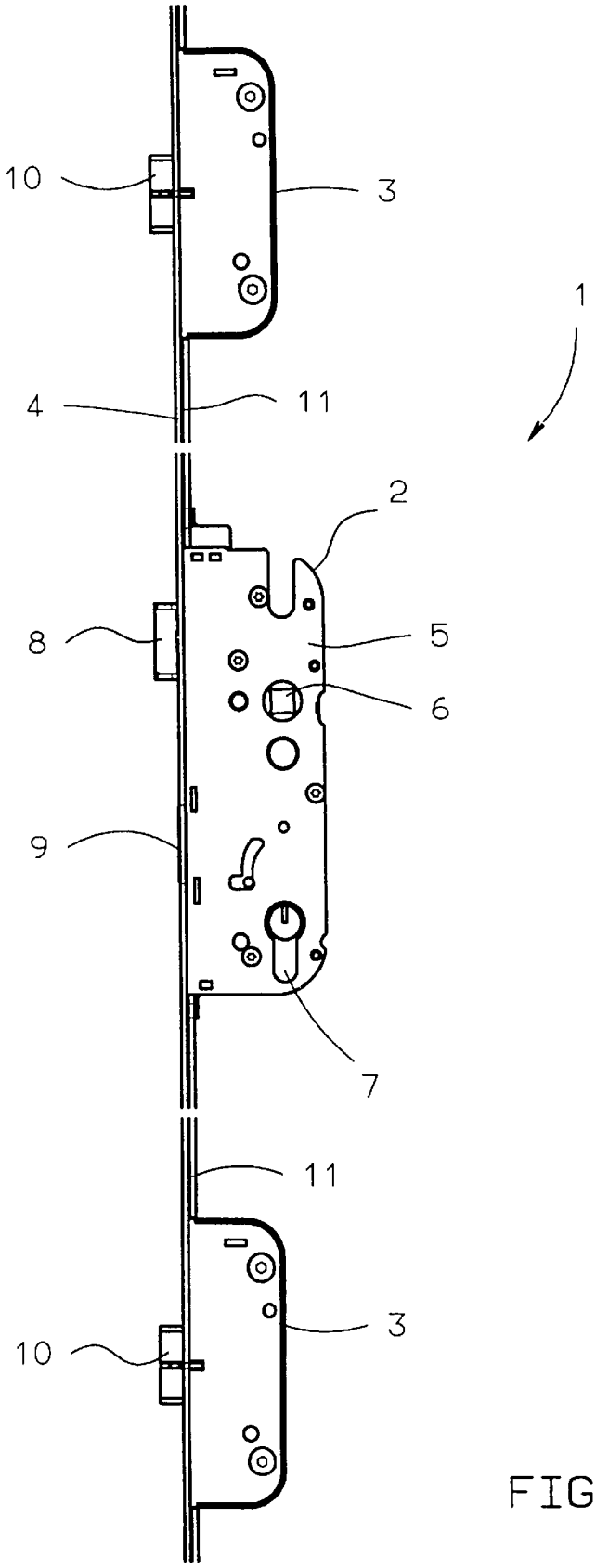
FIG. 1 is a front view of a first embodiment of the locking device according to the present invention, including a main lock box and two supplementary lock boxes disposed on either side, the latches of the lock boxes being in the latching position.

The locking device shown in FIG. 1 and identified overall by reference numeral 1 comprises one main lock box 2 and two supplementary lock boxes 3. The lock boxes 2 and 3 are secured to a lock faceplate 4. The main lock box 2 is closed with a box lid 5, a handle follower 6, a lock cylinder 7, a latch 8, and a bolt 9. The latch 8 is in the latching position, so that it can be pressed into the main lock box 2 from an edge plate 33, shown in FIG. 6, that is located on the door frame. The bolt 9 is in the retracted position. The supplementary lock boxes 3 are likewise provided with a latch, these latches being embodied as latch bolts 10. The latch bolts 10 are also located in their latching position and can thus be pressed inward into the respective supplementary lock box 3 from an edge plate 33. Finally, a drive rod 11 can also be seen, which connects the main lock box 2 to the supplementary lock boxes 3.

Figure 2:
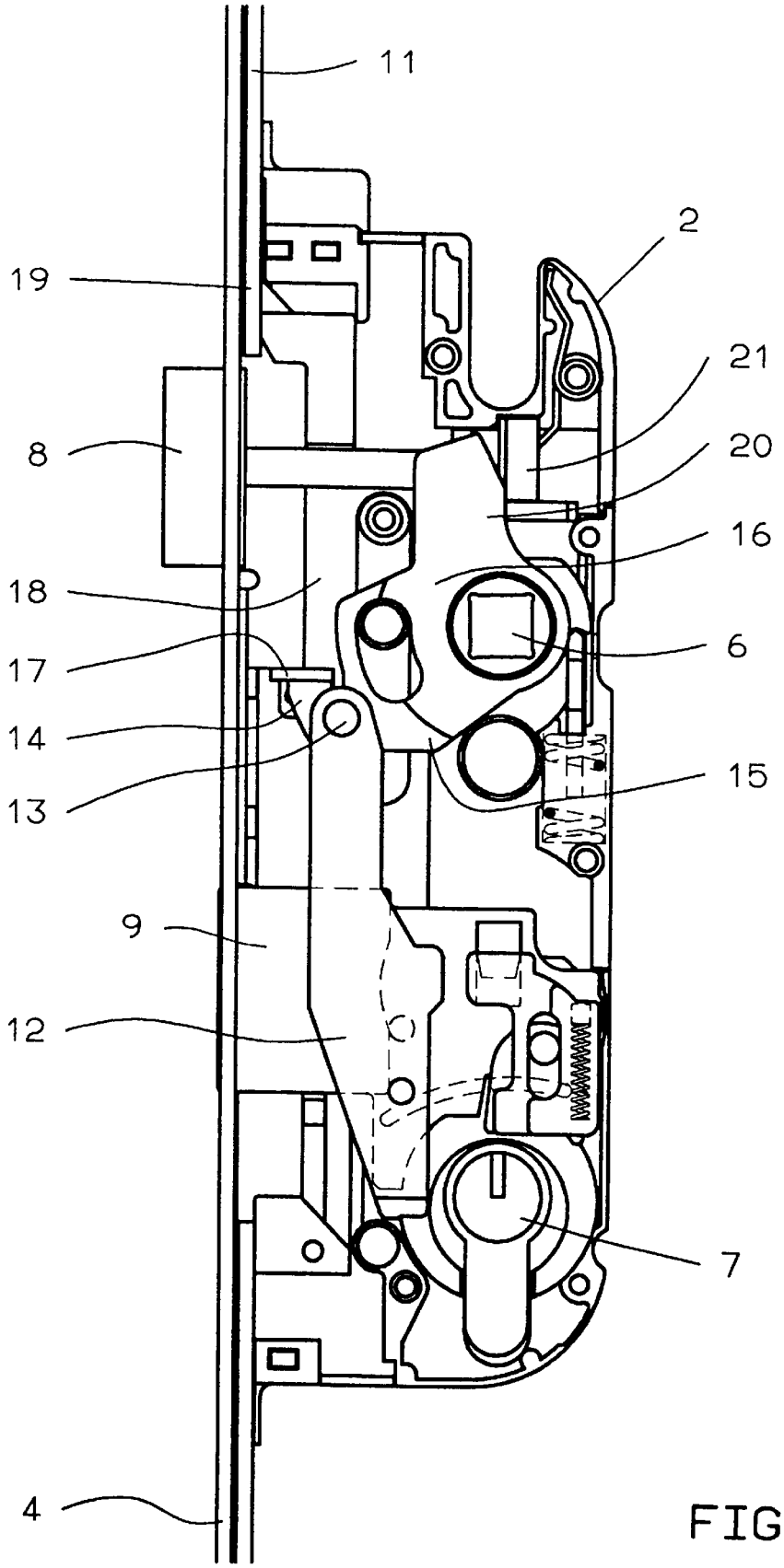
FIG. 2, a front view of the main lock box with the box lid removed, the bolt retracted, and the latch in the latching position.

In the front view shown in FIG. 2 of the main lock box 2, the box lid 5 has been removed, so that the interior components of the lock can be seen. For instance, the change lever 12 actuatable by the lock cylinder 7; engages a slide 14 of an arm 15 of a control follower disk 16 via pin 13. The slide 14 acts on a displacement stop 17, which is secured to a control plate 18. In this control plate 18, the drive rod 11 is suspended at 19. The control follower disk 16 has a further arm 20, which rests on a tail 21 of the latch 8.

If the change lever 12 and the control follower disk 16 are actuated clockwise via the lock cylinder 7 and via itself, respectively, then the latch 8 is retracted into the main lock box 2 via the arm 20 and the latch tail 21. However, this can also be done via a handle, not shown. The handle follower 6 is actuated clockwise, with the handle follower 6 carrying the control follower disk 16 along in its rotary motion. Moreover, upon actuation of the lock cylinder 7 or handle follower 6, the slide 14, and via it, the control plate 18 are shifted, thereby actuating the drive rod 11.

Figure 3:
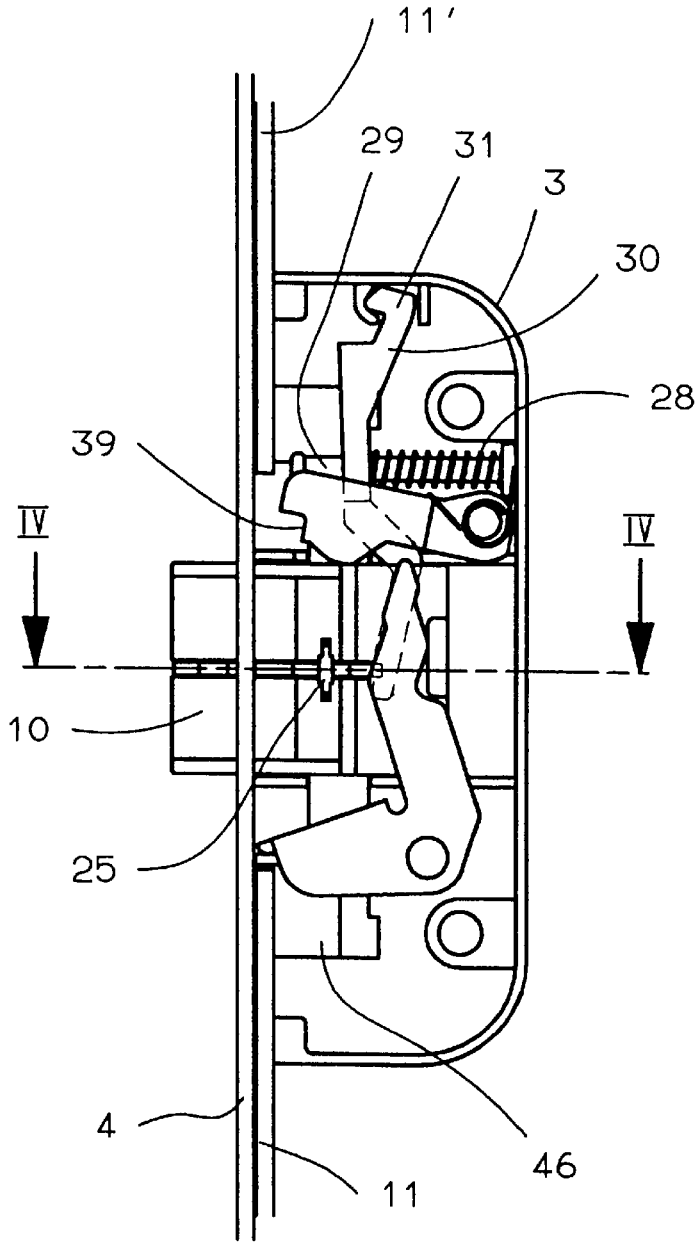
FIG. 3 is a front view of the supplementary lock box with the box lid removed and the latch in the latching position.

The supplementary lock box 3 is connected to this drive rod 11 as shown in FIG. 3. In the supplementary lock box 3, shown without the box lid, the latch bolt 10 is supported so as to be displaceable in the direction of the section line. The latch bolt 10 is in the latching position in FIGS. 3 and 4; in this position the latch bolt 10 with its contact incline 22 (FIG. 4) protrudes past the faceplate 4.

Figure 4:
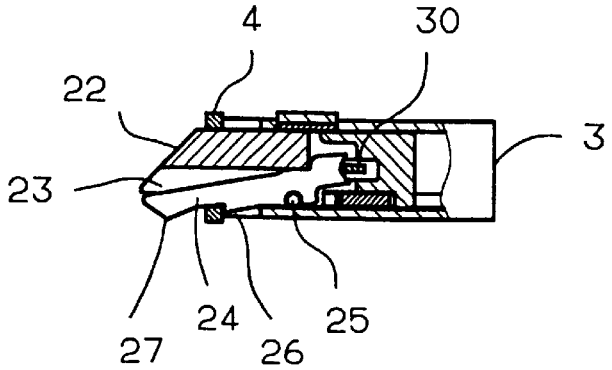
FIG. 4 is a section through the latch taken along the line IV—IV of FIG. 3.

It can also be seen in FIG. 4 that the latch bolt 10 is provided with a groove 23 open on one side and extending in the longitudinal direction of the latch bolt. Located in this groove 23 is a blocking element 24, which is pivotable in the groove 23 around a tension sleeve 25 and is thus supported in the latch bolt 10. This blocking element is provided with a blocking pawl 26 and a tripping pawl 27.

In the latching position, which is shown in FIG. 4, the blocking pawl 26 engages the faceplate 4 from behind and prevents further projection of the spring-loaded latch bolt 10. This spring force is brought to bear by a latch projection spring 28 (FIG. 3), which is thrust onto a spring guide pin 29 and is braced on one side against the inner wall of the housing of the supplementary lock box 3 and on the other on a latch projection lever 30. This latch projection lever 30 is pivotably supported in a bearing 31. The end of the latch projection lever 30 opposite the bearing 31 engages the end of the blocking element 24 opposite the tripping pawl 27 and forces it in the projection direction under the force of the latch projection spring 28. Since the blocking element 24 is connected to the latch bolt 10 via the tension sleeve 25, the latch bolt is likewise forced in the projection direction.

It can be seen in FIG. 4 that the latch projection lever 30 does engage the blocking element 24, but the direction of force of the latch projection lever 30 does not pass through the pivot bearing of the blocking element 24, which bearing is embodied by the tension sleeve 25, so that the latch projection lever 30 exerts a counterclockwise pivoting moment on the blocking element 24. Because of this pivoting moment, the blocking pawl 26 and the tripping pawl 27 are lifted out of the groove 23.

When the door is open (not shown), the latch bolt 10 is accordingly in the latching position shown in FIGS. 3 and 4, in which a further projection is prevented by engagement of the faceplate 4 from behind by the blocking pawl 26.

Figure 6:
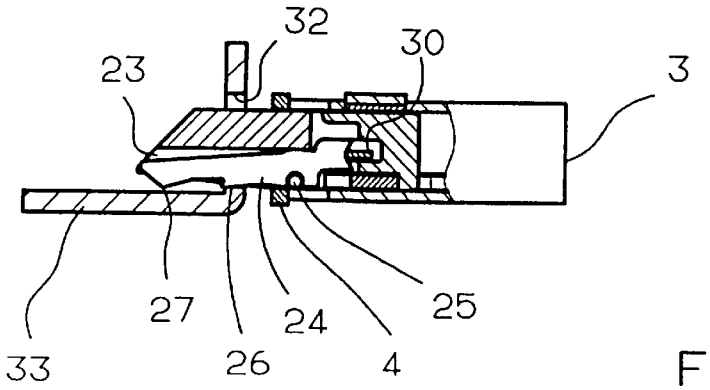
FIG. 6 is a section through the latch taken along the line VI—VI of FIG. 5.

As the door is being closed or shut, the latch bolt 10 is retracted into the supplementary lock box 3 via the edge plate 33 (FIG. 6).

If the door is in its locking position and the latch bolt 10 is aligned with the latch opening 32 in the edge plate 33 of the door frame (FIG. 6), then the fully retracted latch bolt 10 is pushed out of the supplementary lock box 3 via the latch projection lever 30. During this projection motion, the blocking element 24 is simultaneously pivoted counterclockwise about the tension sleeve 25. In this process, the tripping pawl 27 comes into contact with the edge facing it of the latch opening 32 of the edge plate 33, and as a result the blocking element 24 is retracted counter to the swiveling moment into the groove 23 so far that the blocking pawl 26 can slide past the faceplate 4. In this way, locking of the latch bolt 10 in the latching position of FIG. 4 is prevented, and so the latch bolt 10 is capable of moving outward into the locking position. In this locking position, the latch bolt 10 has moved approximately 10 mm to 15 mm farther out of the supplementary lock box 3 than in the latching position shown in FIGS. 3 and 4.

In a further embodiment, the latch projection lever 30, after pivoting of the blocking element 24, can rest directly on the latch bolt and move it outward into the locking position.

Figure 5:
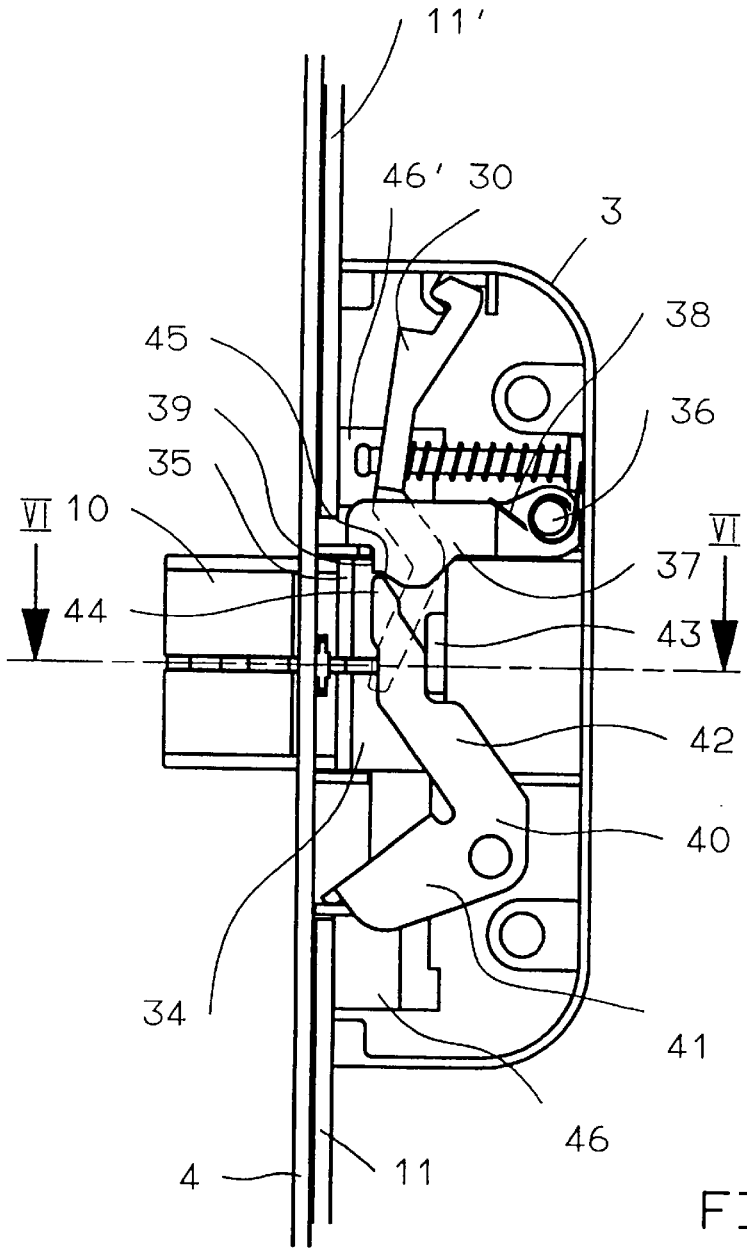
FIG. 5 is a view corresponding to FIG. 3, but with the latch in the locking position.

As FIG. 5 shows, the latch tail 34 has a protrusion 35. FIG. 5 also shows that a latch blocking lever 37 is pivotably supported on a bearing pin 36 and is spring-loaded counterclockwise via a blocking lever spring 38, which is embodied as a torsion spring. If the latch bolt 10 is in the fully projected position shown in FIGS. 5 and 6, that is, in the locking position, then a latch blocking edge 39 engages the protrusion 35 from behind. Although a slight spacing may exist between the protrusion 35 and the latch blocking edge 39, as shown in FIG. 5, nevertheless the latch blocking edge 39 intersects the displacement path of the protrusion 35.

If the latch bolt 10 is now thrust into the supplementary lock box 3, for instance by means of a tool or the like, then the protrusion 35 comes to rest on the latch blocking edge 39, and further retraction is prevented. Accordingly, in its locking position the latch bolt 10 is secured against retraction.

Figure 7:
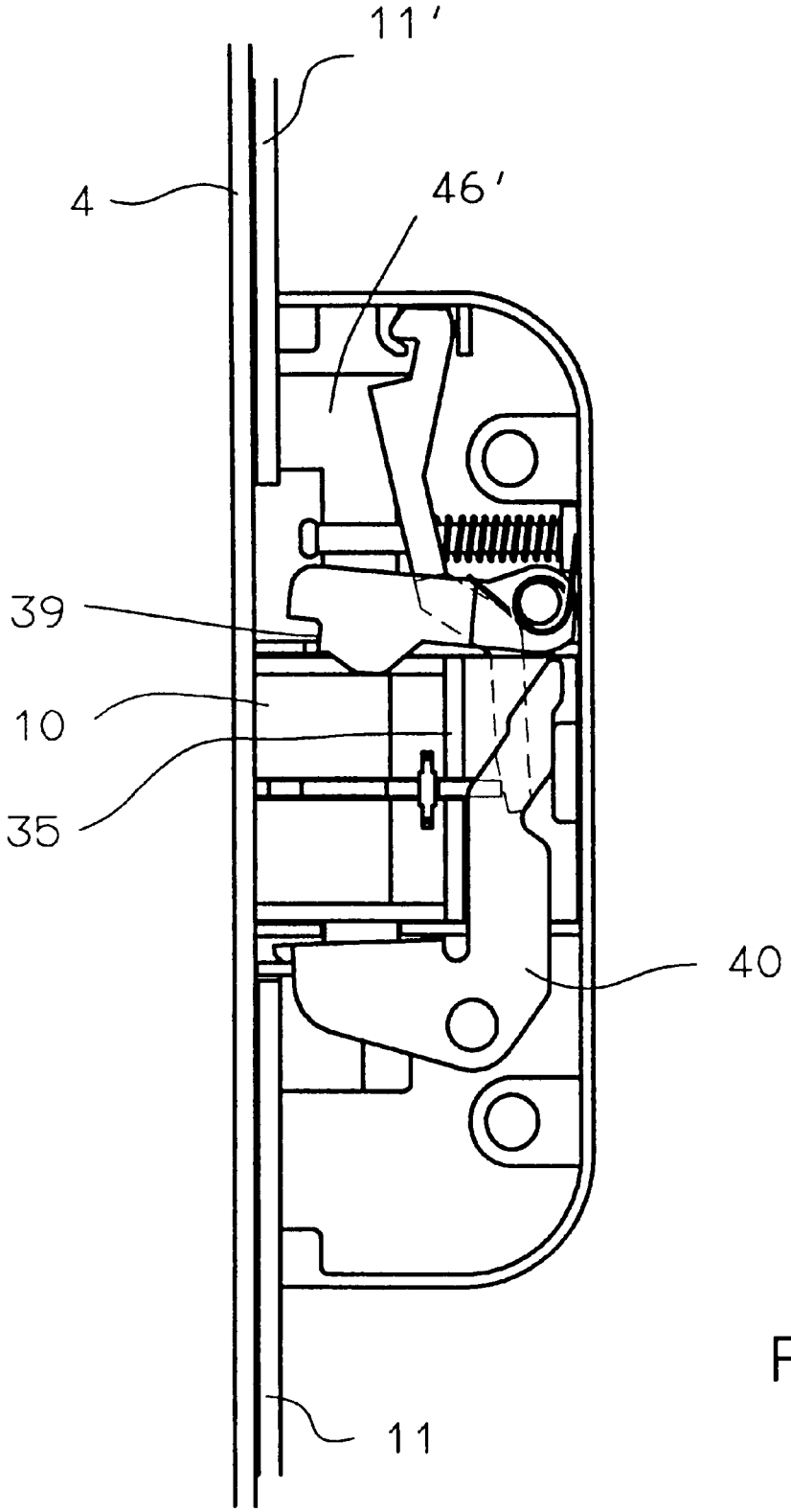
FIG. 7 is a view corresponding to FIG. 6, with the latch retracted into the supplementary lock box.

If a latch restoring lever 40, which with one arm 41 engages the free end of the drive rod 11 and with its other arm 42 engages a further protrusion 43 of the latch tail 34, is pivoted via the drive rod 11, then a pawl 44 of the free end of the arm 42 engages a slot 45 of the latch blocking lever 37 (FIG. 5) and lifts it far enough out of its locking position, in which the latch blocking edge 39 engages the protrusion 35 from behind, that the latch blocking edge 39 moves out of the displacement path of the protrusion 35. The arm 42 also rests on the protrusion 43 and upon swiveling of the latch restoring lever 40 pulls the latch bolt 10 into the supplementary lock box 3 (FIG. 7). Once the latch bolt 10 has been retracted all the way into the box 3, the door can be opened.

When the door is open and the drive rod 11 is in the position of repose, the latch bolt 10 is pushed out via the latch projection lever 30 far enough that the blocking pawl 26 engages the faceplate 4 from behind, as shown in FIG. 5, and prevents its further projection.

On retraction of the latch bolt 10 by shutting the door, the latch restoring lever 40 is indeed pivoted out of this latching position into the supplementary lock box 3, but the arm 41 is lifted away from the drive rod 11, so that this arm is not moved along as well.

A further drive rod 11' can be coupled via suitable drivers 46, 46'.

If the bolt is omitted from the main lock box 2, then a lock with a simple panic function is obtained, since the locked state can be undone at any time by actuating the handle, not shown.

Figure 8:
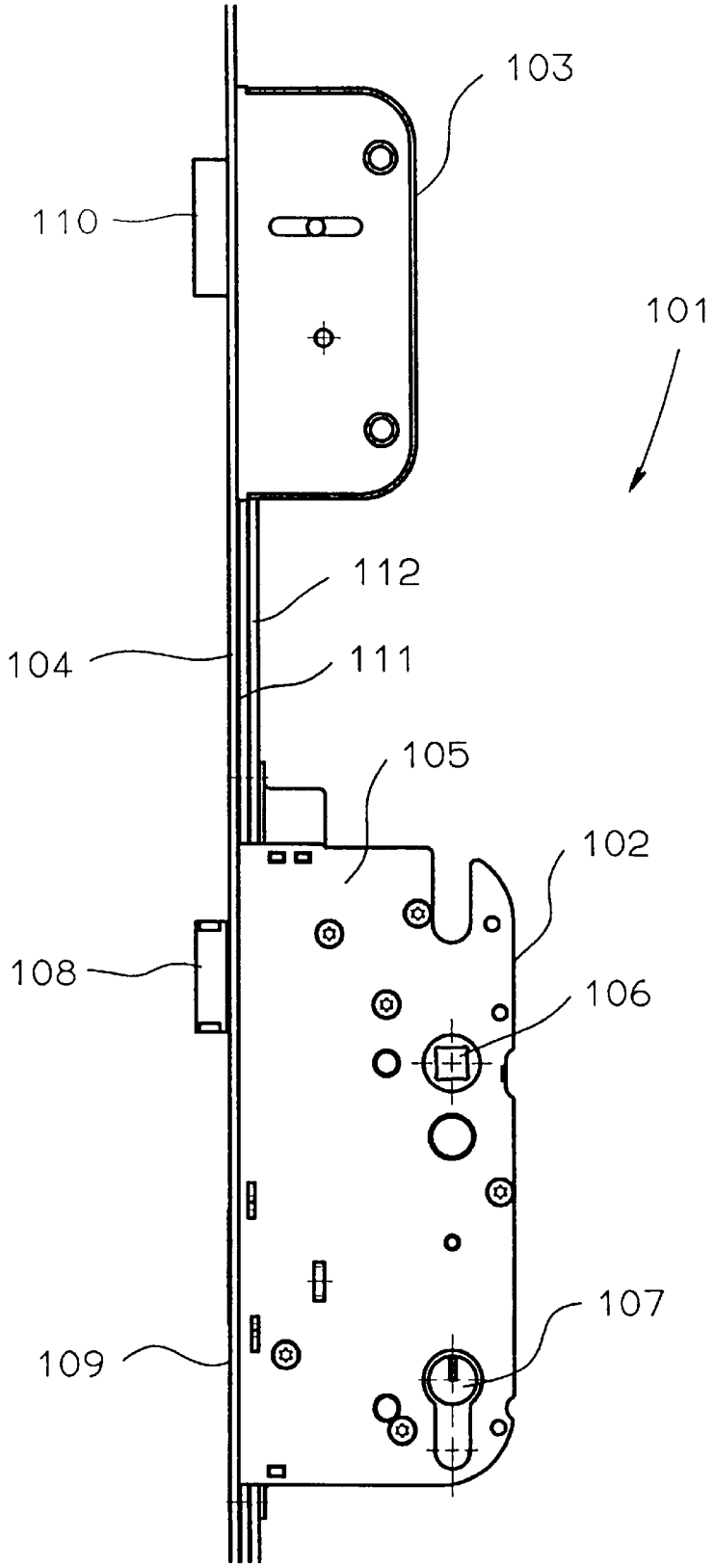
FIG. 8 is a front view of a second embodiment of the locking device of the present invention with a main lock box and a supplementary lock box and with the latches in the latching position.

The second embodiment, shown in FIG. 8 and identified overall by reference numeral 101, of the locking device of the present invention, which may also be a further feature of the locking device described above, comprises one main lock box 102 and one supplementary lock box 103. The lock boxes 102 and 103 are secured to a lock faceplate 104. The main lock box 102 is closed with a box lid 105, and a tripping follower 106, a lock cylinder 107, a latch 108, and a bolt 109 can be seen. The latch 108 is in the latching position, so that it can be pressed into the main lock box 102 by an edge plate, not shown, that is located in the door frame. The bolt 109 is in the retracted position. The supplementary lock box 103 is likewise provided with a latch, which is embodied as a latch bolt 110. This latch bolt 110 is likewise in its latching position and can likewise be pressed into the supplementary lock box 103 from an associated edge plate. Finally, a first drive rod 111 and a second drive rod 112 can also be seen, which connects the main lock box 102 to the supplementary lock box 103.

Figure 9:
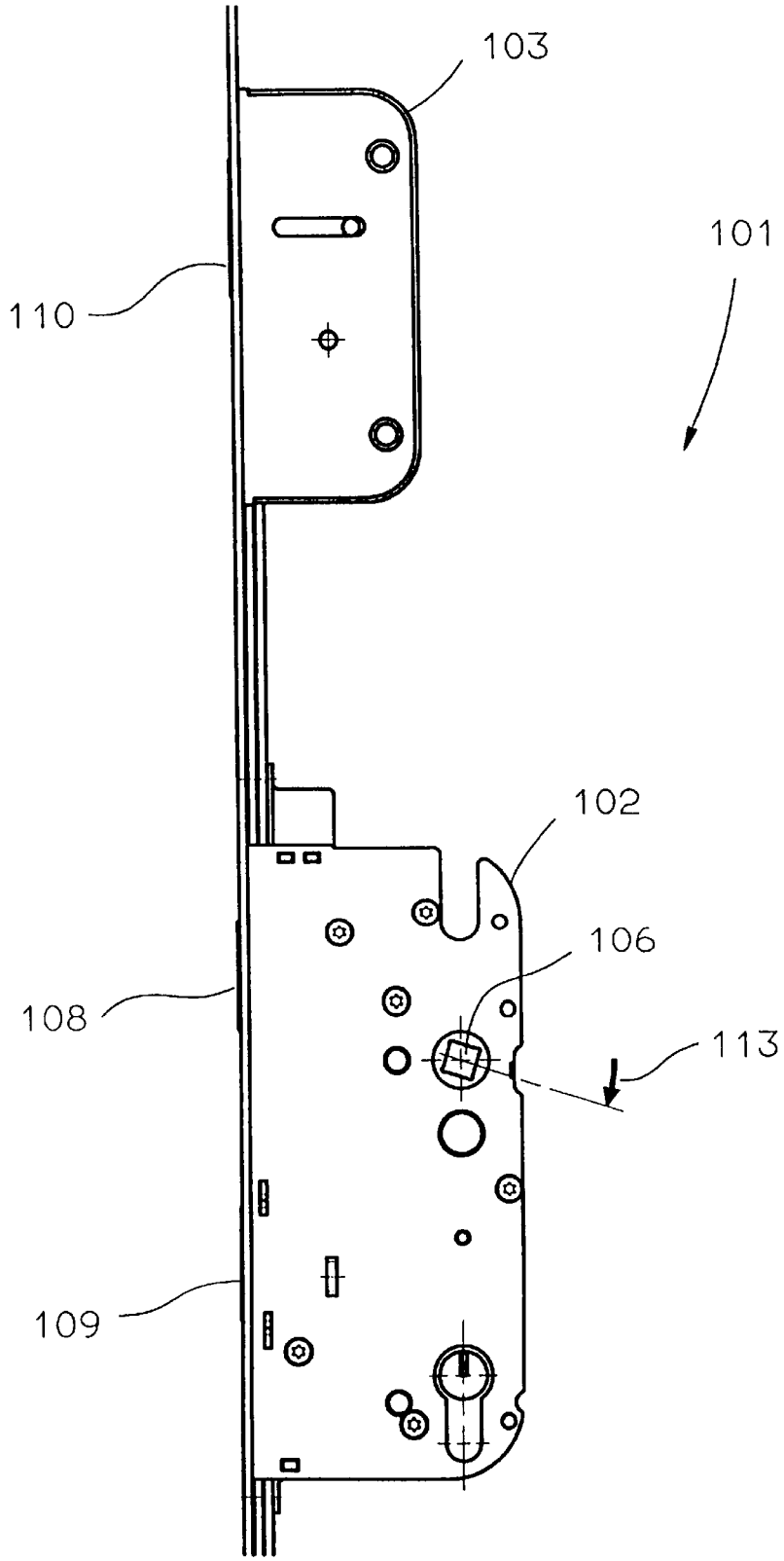
FIG. 9 is a view corresponding to FIG. 8, but in which the handle follower of the main lock box assumes a working position as a result of which the latches have been retracted into the two lock boxes.

FIG. 9 shows the locking device 101 of FIG. 8; here, the handle follower 106 has been actuated by means of a handle, not shown, in the direction of the arrow 113, and as a result both the latch 108 and the latch bolt 110 have been retracted into the corresponding lock boxes 102 and 103, respectively.

Figure 10:
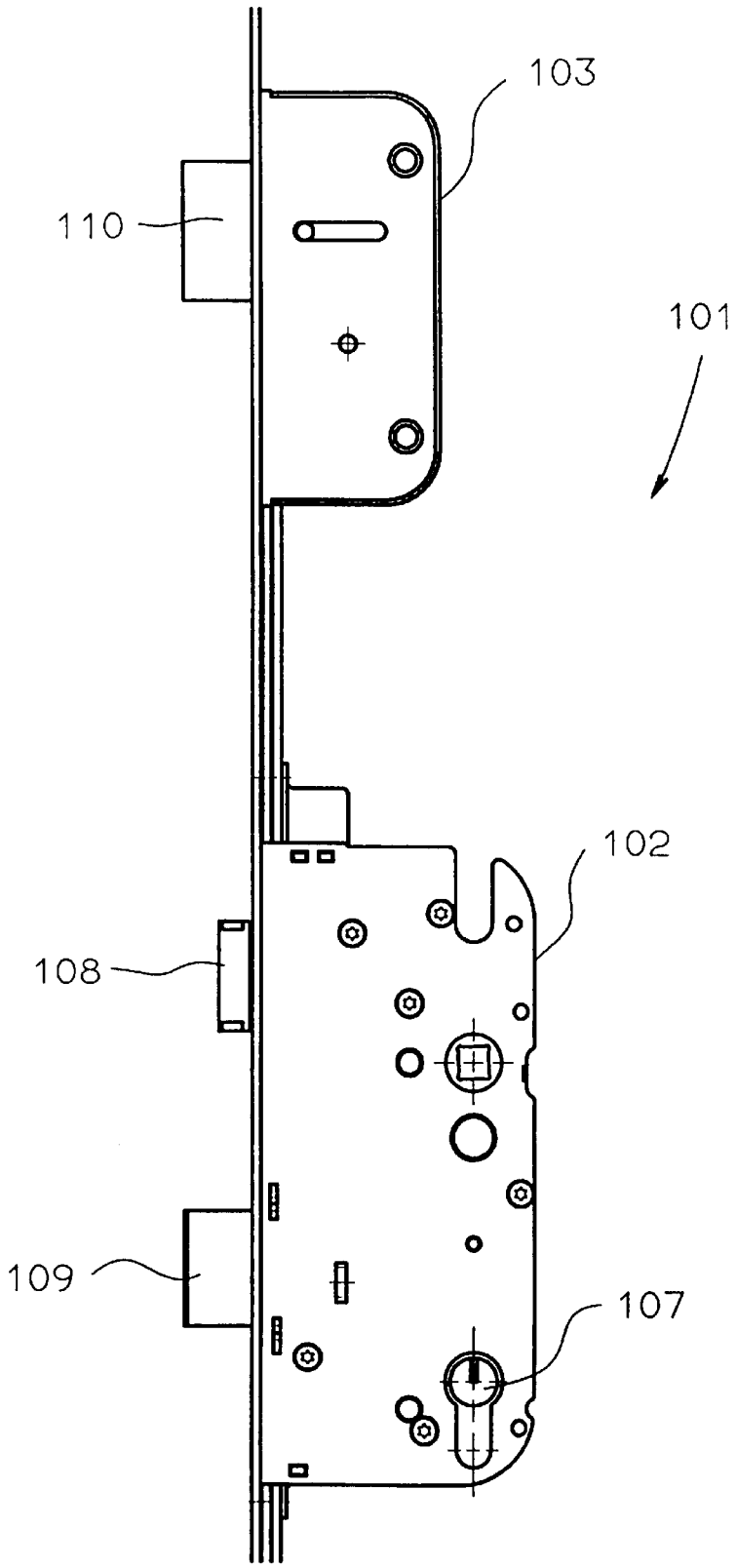
FIG. 10 is a view corresponding to FIG. 8, in which the bolt of the main lock box and the latch bolt of the supplementary lock box are in the locking position.

FIG. 10 again shows the locking device 101 according to the present invention shown in FIG. 8; by actuation of the lock cylinder 107, both the bolt 109 and the latch bolt 110 have been extended. In FIG. 10, the latch bolt 110 assumes its locking position and protrudes past the latch 108 by approximately 10 mm to 15 mm.

Figure 11:
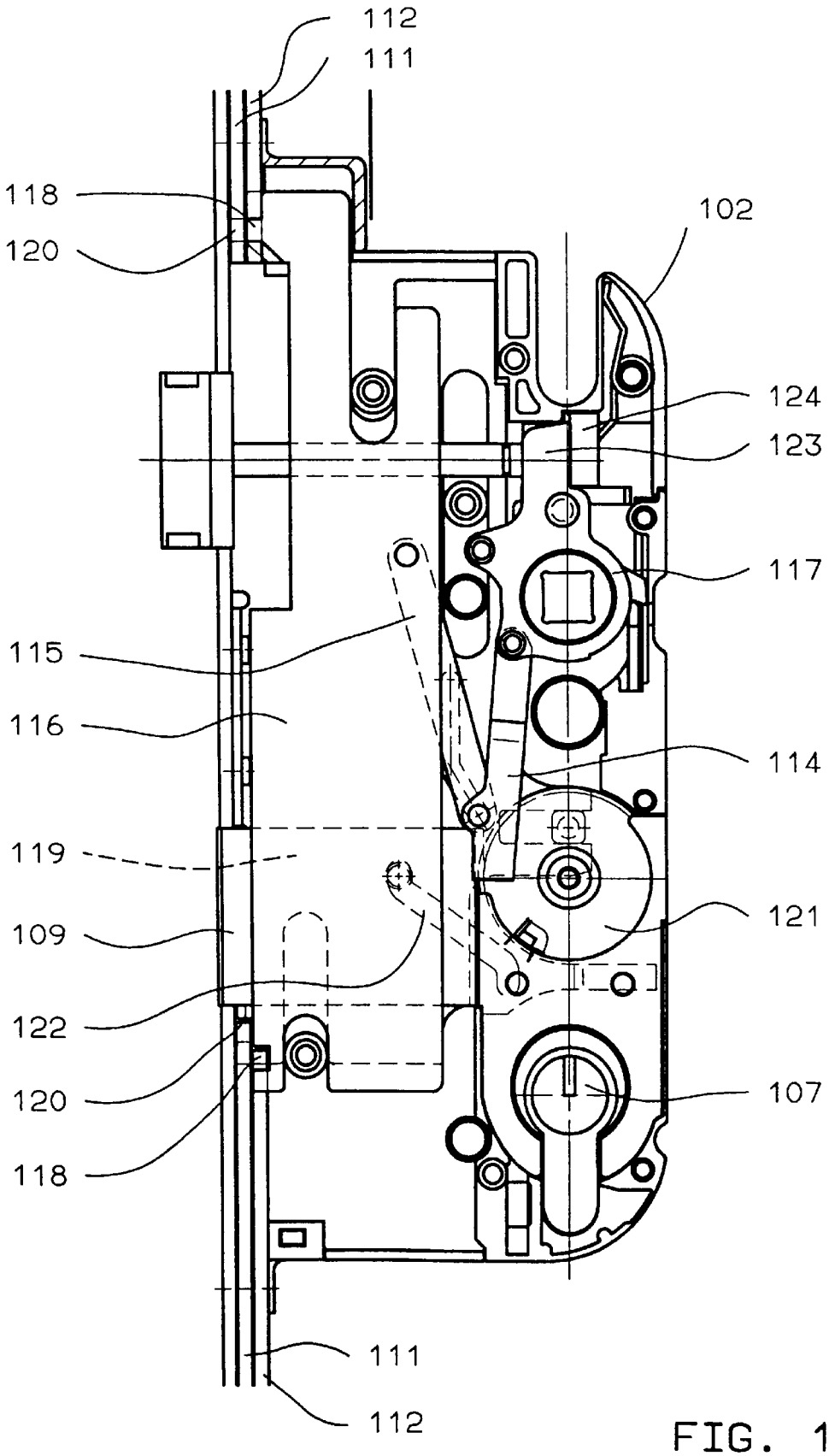
FIG. 11 is a front view of the main lock box with the box lid removed, the bolt retracted and the latch in the latching position.

In the main lock box 102 view shown in FIG. 11, the box lid 105 has been removed, making the lock fittings visible.

Figure 13:
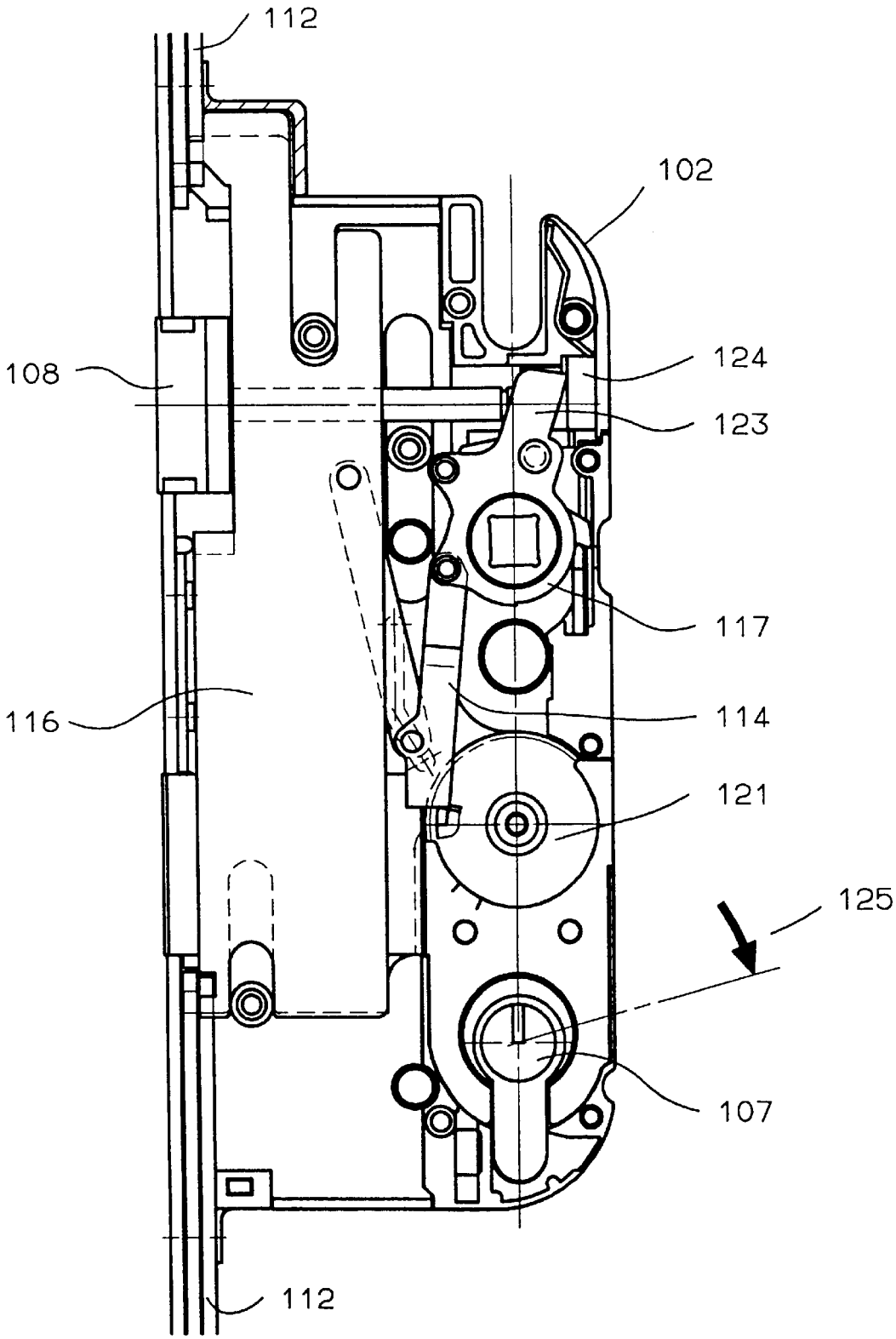
FIG. 13 is a view of the main lock box in accordance with FIG. 11, in which the lock cylinder assumes a working position, the bolt is retracted, and the latch is retracted into the lock box.

The change lever 114 actuatable by the lock cylinder 107 can be seen; via a connecting rod 115, it is connected to a second control plate 116 and to a control follower disk 117. The second drive rod 112 is coupled to the second control plate 116 via suitable drivers 118. Located parallel to the second control plate 116 is a first control plate 119, to which the first drive rod 111 is coupled via suitable drivers 120. The drive of the first control plate 119 is effected via the lock cylinder 107, which is coupled to a gear, for instance a planetary gear 121, which is shown merely in suggested fashion. With this first control plate 119, the bolt 109 can be pushed out of the main lock box 102 via a slot 122. On actuation of the planetary gear 121 to the reverse closing direction (FIG. 13), the change lever 114 is actuated; besides the second control plate 116, it drives the control follower disk 117 as well. An arm 123 engages a latch tail 124 from behind and, as shown in FIG. 13, pulls the latch 108 into the main lock box 102. The lock cylinder 107 is actuated in the direction of the arrow 125. The second control plate 116 and with it the second drive rod 112 is also displaced.

Figure 12:
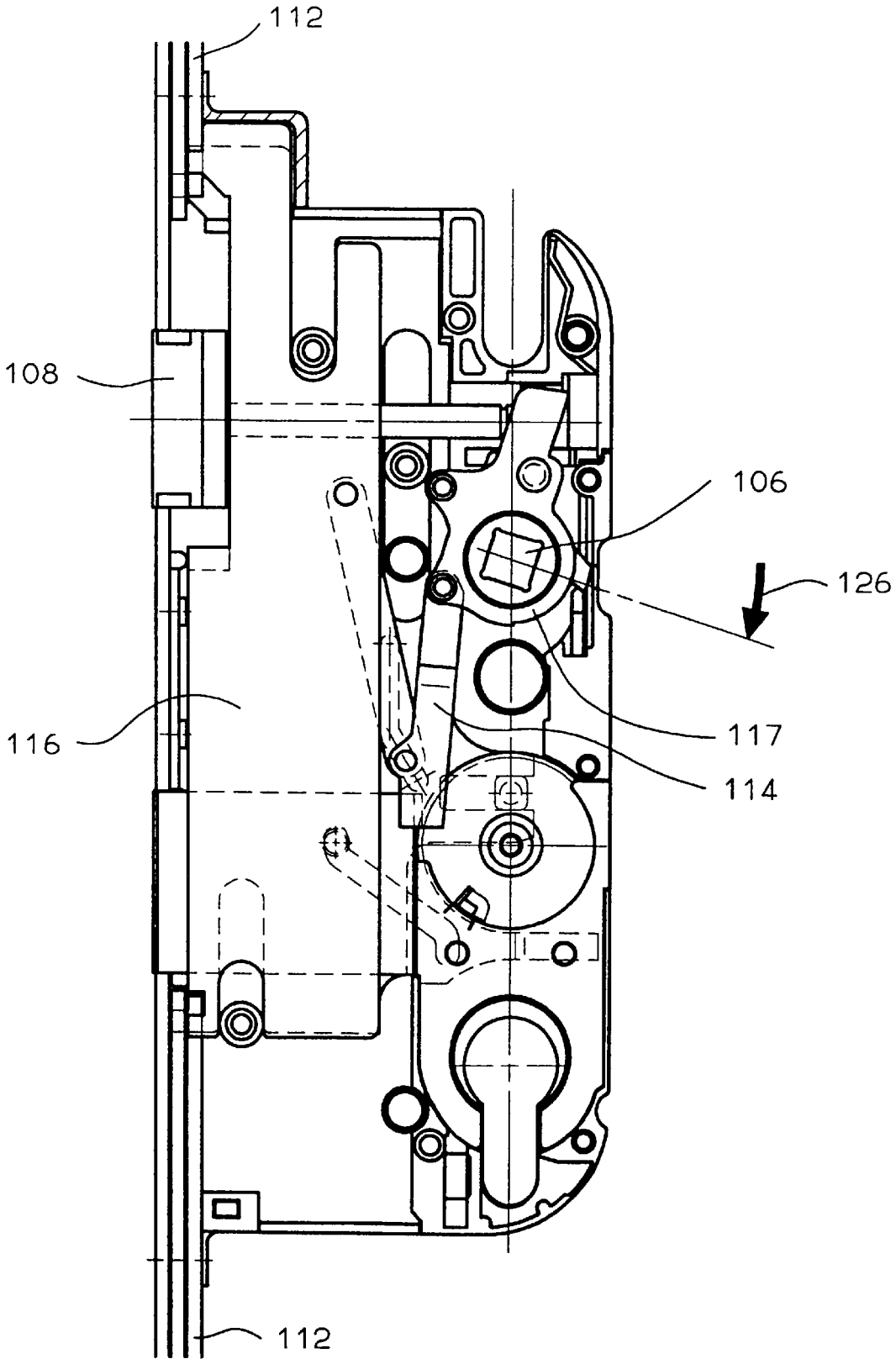
FIG. 12 is a view of the main lock box corresponding to FIG. 11, in which the handle follower assumes a position like that shown in FIG. 9.

If as shown in FIG. 12 the handle follower 106 is rotated in the direction of the arrow 126 by means of a handle, not shown, then the control follower disk 117 is likewise displaced clockwise and the latch 108 is retracted. Since the change lever 114 is pivotably connected to the control follower disk 117, the second control plate 116 and with it the second drive rod 112 is displaced as well, as described above.

Figure 14:
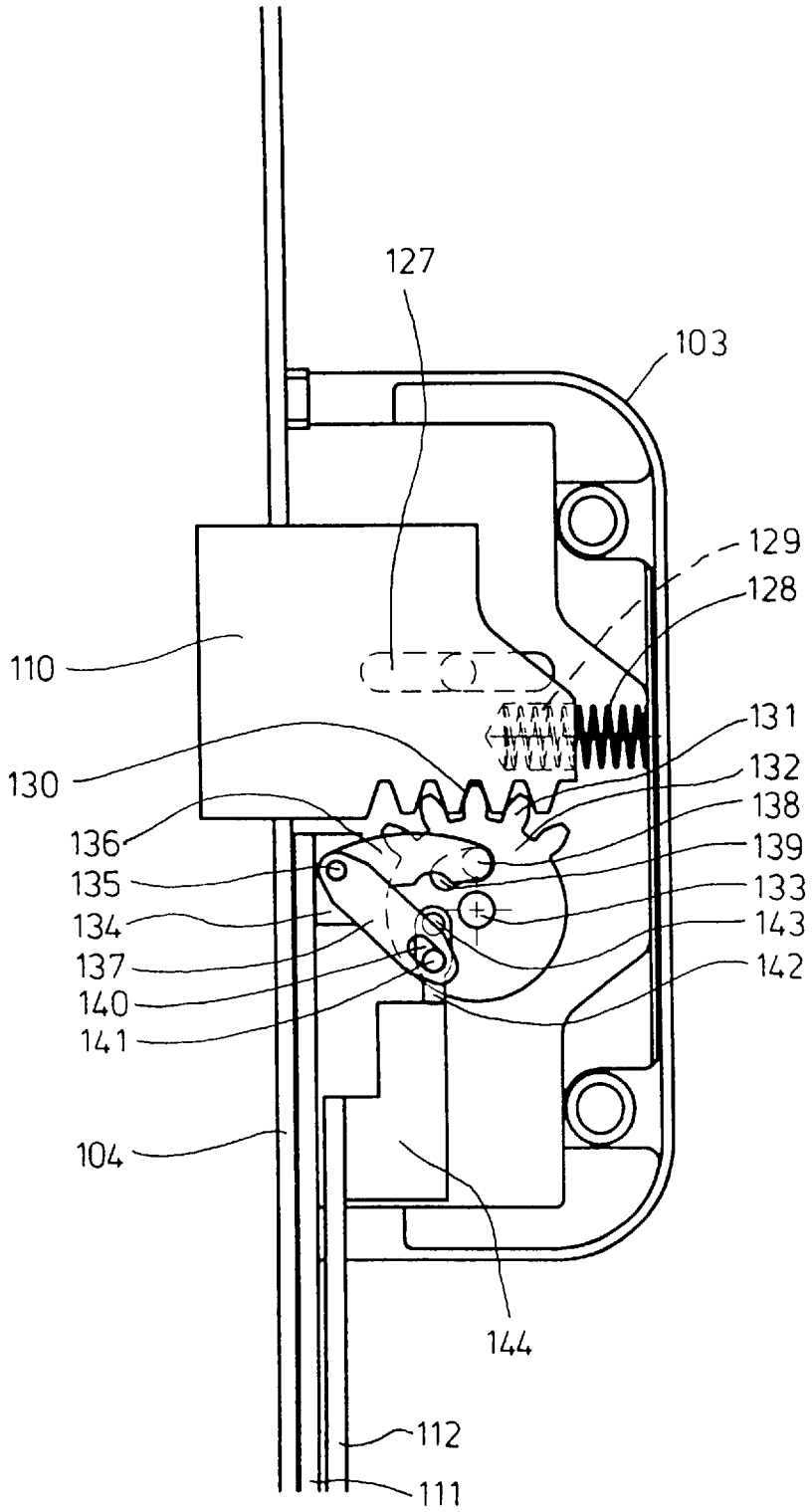
FIG. 14 is a front view of the supplementary lock box with the latch bolt in the latching position.

The supplementary lock box 103 is connected to this drive rod 112, as shown in FIG. 14. In this supplementary lock box 103, the latch bolt 110 is supported displaceably in the longitudinal direction of the slit via a slit guide 127. In FIG. 14, the latch bolt 110 assumes its latching position, in which with its contact incline it protrudes beyond the faceplate 104 (as in FIG. 4). Via the force of a projection spring 128 (compression spring), which is supported against the inner wall of the housing of the supplementary lock box 103 and is received in a bore 129 that is provided on the back side of the latch bolt 110, the latch bolt 110 is forced out of the supplementary lock box 103.

One longitudinal side of the latch bolt 110 is embodied over a portion of its length as a rack 130 and meshes with a split toothed ring 131 of a drive wheel 132 that is rotatably supported on a journal 133. The free end of the first drive rod 111 has a driver 134, which is provided with a journal 135. A first tab 136 and a second tab 137 are pivotably secured to this journal 135. The free end of the first tab 136 is provided with a pin 138, which engages an oblong slot 139 of the drive wheel 132, this slot being curved in the circumferential direction. The free end of the second tab 137 is provided with an oblong slot 140 which is engaged by a journal 141. This journal 141 is secured to a slide 142, which in turn is pivotably connected to the drive wheel 132 by a journal 143. A driver 144 of the second drive rod 112 engages the free end of this slide 142.

In FIG. 14, the latch bolt 110 is in the latching position and protrudes beyond the faceplate 104 essentially with its contact incline, not shown (as in FIG. 4). In this position, the rod 138 rests on one end of the oblong slot 139, and the slide 142 is supported by its free end on the driver 144.

If as shown in FIG. 10 the bolt 109 is extended via the lock cylinder 107, then the first control plate 119 and with it the first drive rod 111 (see FIG. 15) are moved downward in the direction of the arrow 145. As a result of this shift, the slide 142 is moved via the second tab 137 out of operative range of the driver 144, in that the slide 142 is pivoted counterclockwise about the journal 143. The first tab 136 after traversing the oblong slot 139, also drives the drive wheel 132, so that this wheel is likewise rotated counterclockwise about the journal 133. This rotary motion, via the engagement of the split toothed ring 131 with the rack 130, effects a projection motion of the latch bolt 110. The latch bolt now assumes its locking position. In this position of the drive components, a displacement of the second drive rod 112 causes no change of position of the drive wheel 132, since the driver 144 and the drive wheel 132 are not operatively connected.

Figure 16:
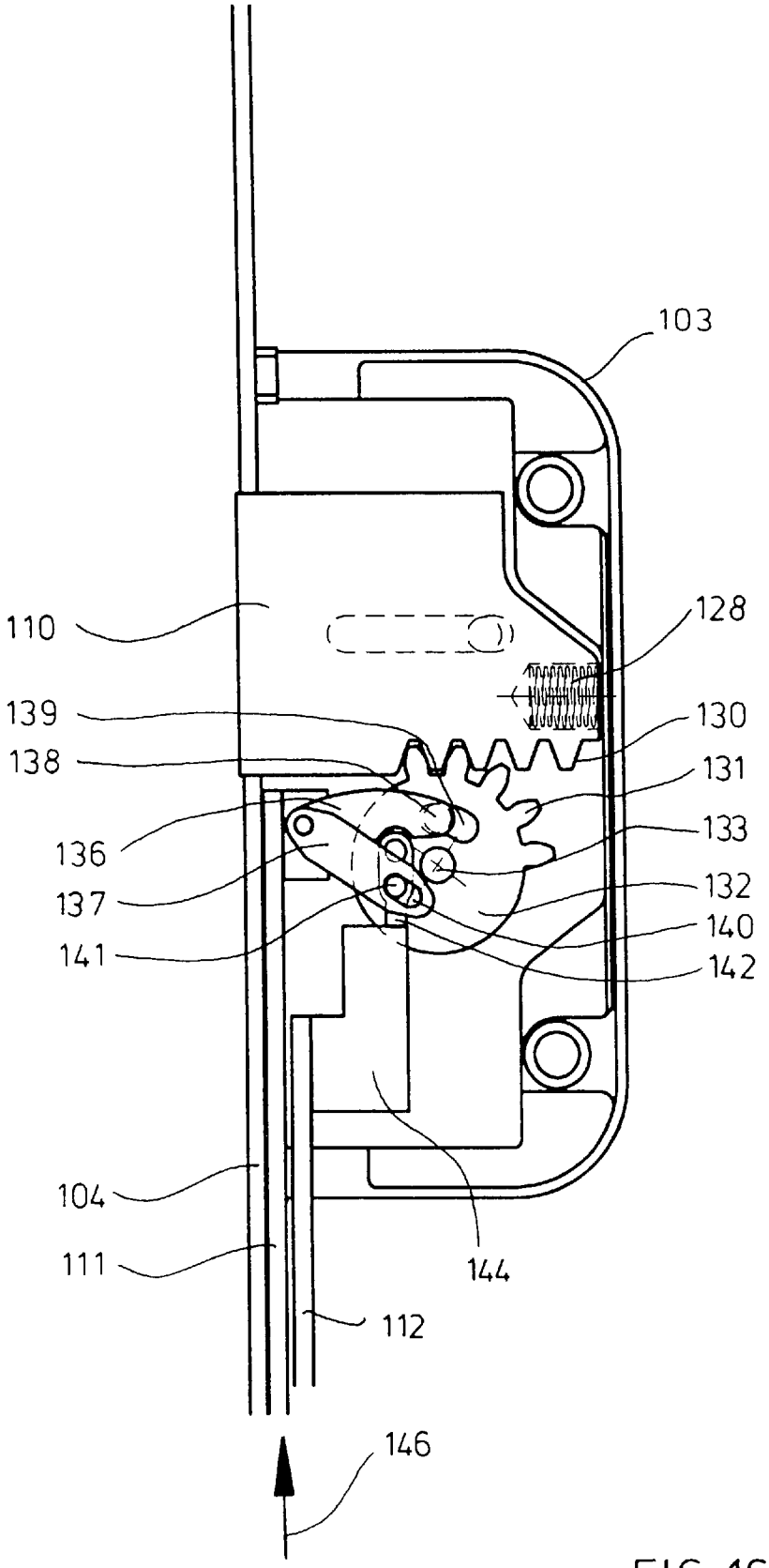
FIG. 16 is a view of the supplementary lock box of FIG. 14 in which the latch bolt has been retracted into the lock box.

If beginning at the position of FIG. 14 either the handle follower 106 as in FIG. 12 or the lock cylinder 107 as in FIG. 13 is actuated, then the drive rod 112 is shifted in the direction of the arrow 146 (FIG. 16). The driver 144, which is connected to the drive wheel 132 via the slide 142, upon its shift causes the drive wheel 132 to be rotated clockwise about the journal 133. The split toothed ring 131 drives the rack 130 of the latch bolt 110 and pulls the latch bolt back into the supplementary lock box 103. This compresses the projection spring 128. The rotation of the drive wheel 132 is hindered neither by the first tab 136 nor the second tab 137, since the pin 138 of the free end of the first tab 136 can deflect within the oblong slot 139, and the journal 141 of the slide 142 can deflect in the oblong slot 140 of the free end of the second tab 137.

As can be seen in FIG. 14, when the latch bolt 110 is retracted, for instance by means of a tool inserted into the gap between the door and the door frame, the drive wheel is indeed rotated clockwise about the journal 133, but the first drive rod 111 remains in repose, since neither the pin 138 of the first tab 136 nor the second tab 137 is entrained via the journal 141, as can be seen from FIG. 16. Thus if the latch bolt 110 is retracted without authorization, then neither the first drive rod 111 nor the second drive rod 112 is actuated via this latch bolt 110. Hence the other bolt 109 or latch bolt 110 remains in its extended position.

Figure 15:
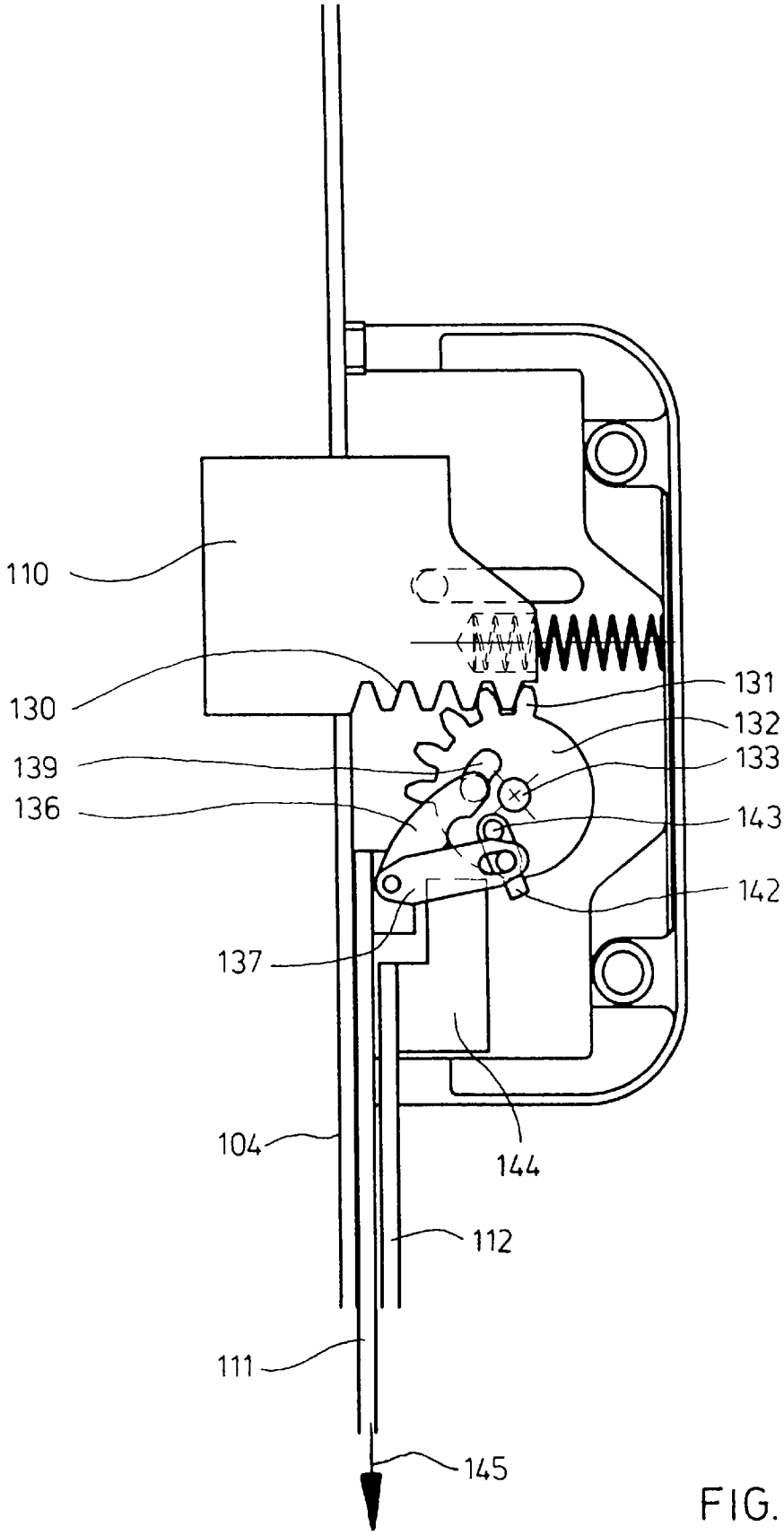
FIG. 15 is a front view of the supplementary lock box of FIG. 14 with the latch bolt in the latching position.

FIG. 15 shows the latch bolt 110 in the locked position, in which the latch bolt 110 can be locked, by means of a latch blocking lever (not shown) embodied as in the embodiment shown in FIG. 5, against being retracted without authorization. The control of this latch blocking lever is then accomplished analogously via a motion of the drive rod 111. This achieves increased protection against break-ins.

Figure 17:
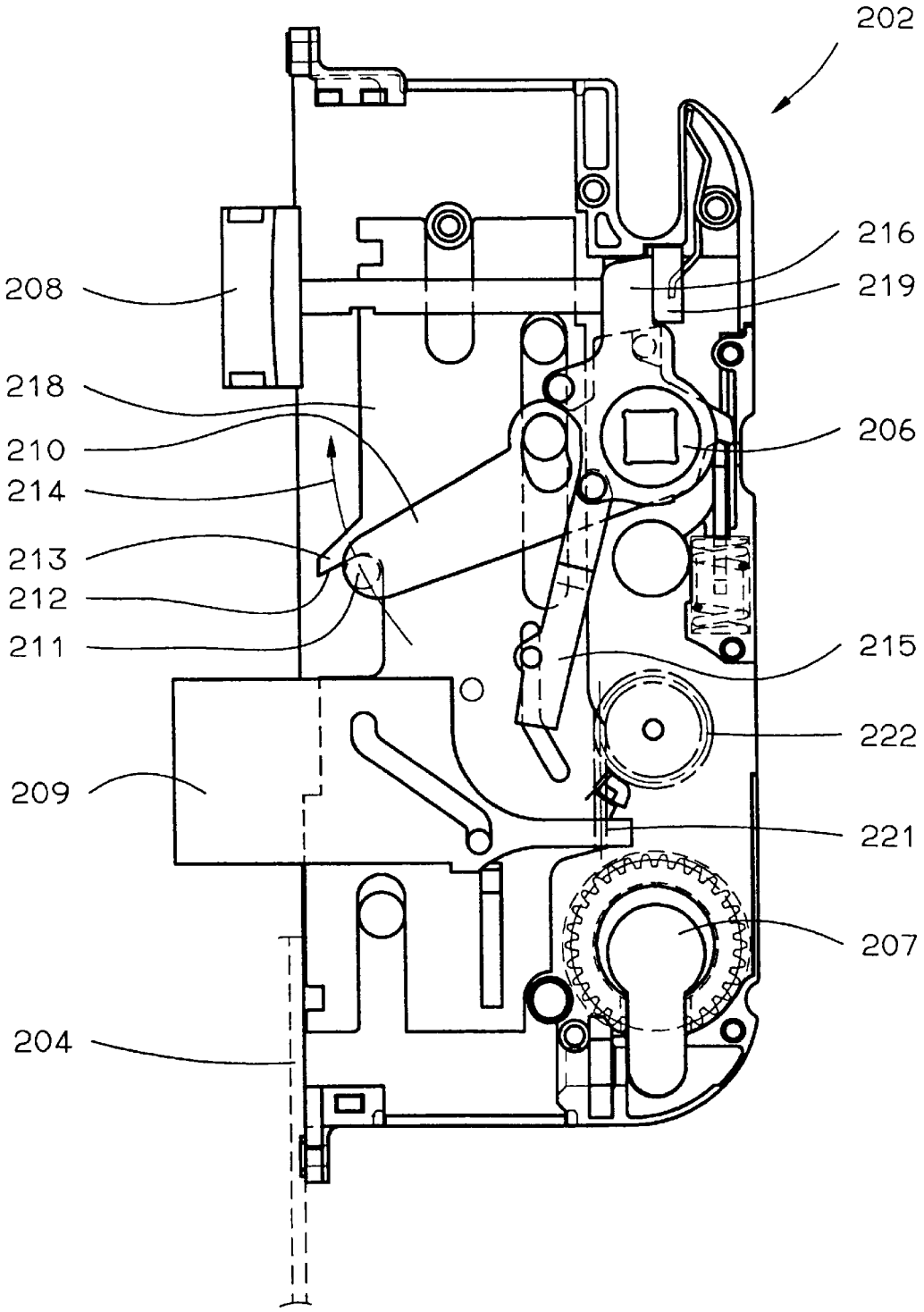
FIG. 17 shows a further exemplary embodiment of a main lock box of the locking device of the present invention with an extended bolt and a latch in the latching position, this main lock box being embodied as a panic lock.

FIG. 17 shows a further embodiment of a main lock box 202, which is embodied as a full panic lock. This main lock box 202 again has both a handle follower 206 and a lock cylinder 207. An actuating lever 210 is fastened, in a manner fixed against relative rotation, to the handle follower 206 and is provided with a journal 211 on its free end. This journal 211 engages a control cam 212 that is formed onto the control plate 218. To that end, the control plate 218 has a pawl 213, formed onto the edge of the control plate 218 in the direction of a lock faceplate 204 shown merely in suggestion fashion; this pawl is also inclined downward. In this way, the control cam 212 is likewise inclined not only in the direction of the faceplate 204 but also downward. If the handle follower 206 is rotated clockwise with a handle, not shown, then the journal 211 provided on the free end of the actuating lever 210 is swiveled upward in the direction of the arrow 214 and carries the pawl 213 of the control plate 218 along with it. In this process, the journal 211 slides along the control cam 212 and moves in the direction of the free end of the pawl 213. Since the pawl 213 is inclined downward, the control plate 218 is raised additionally beyond the degree of inclination of the pawl 213, supplementally to the usual reciprocating motion, by the shifting of the journal 211 in the direction of the free end of the pawl 213. In this way, a step-up gear is formed, with which the control plate 218 is raised to a greater extent than the journal 211 of the actuating lever 210.

Figure 18:
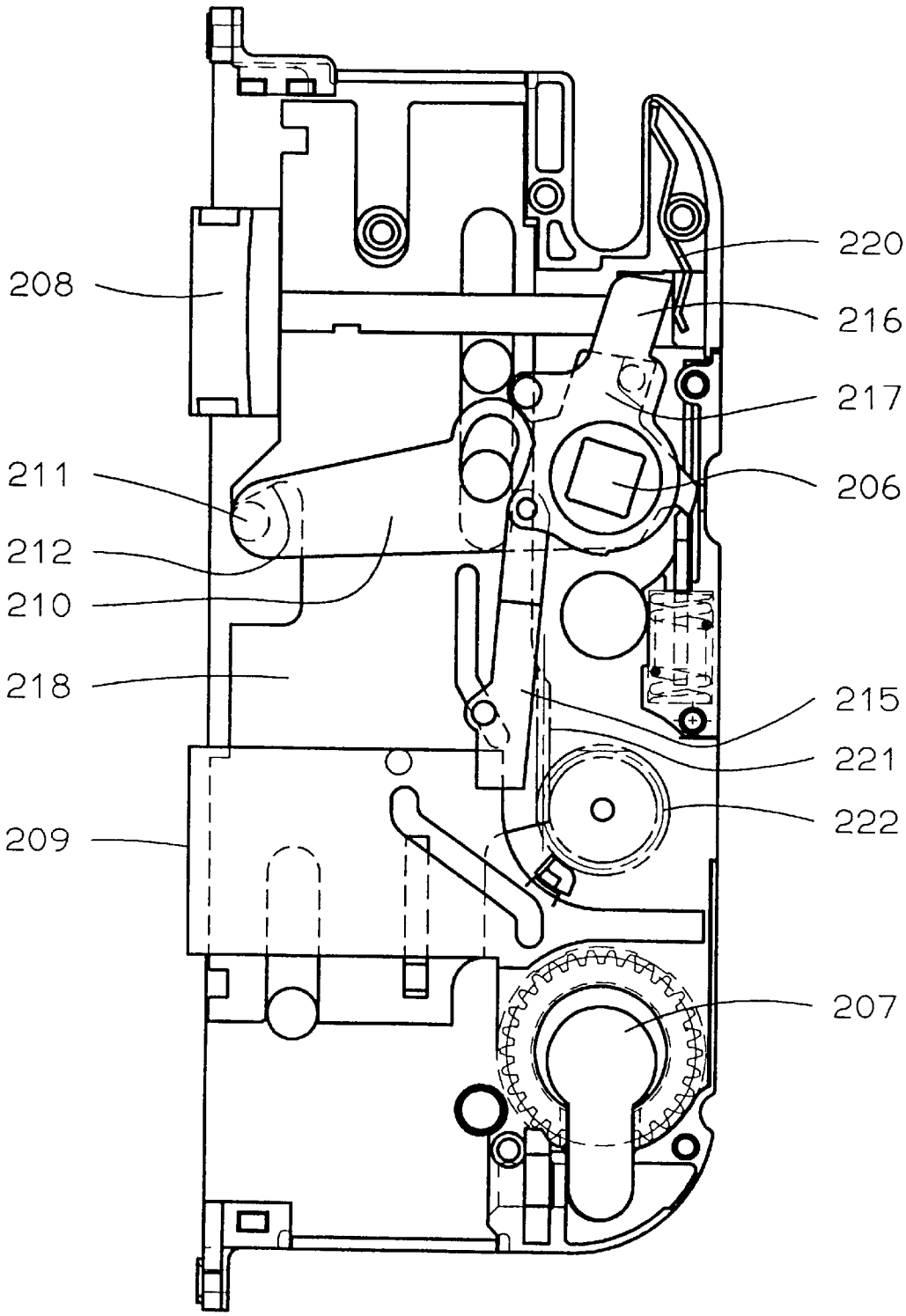
FIG. 18 shows the main lock box of FIG. 17 with a latch retracted into the box and a retracted bolt.

The pivoting of the actuating lever 210, which causes a displacement of the control plate 218, retracts the bolt 209, which is connected to the control plate 218 via a journal-and-oblong-slot connection. The handle follower 206, as already described for the other exemplary embodiments, is likewise provided with a handle follower disk 217, which acts upon a tail 219 of the latch 208 via an arm 216. A clockwise rotation of the handle follower 206 thus also causes a retraction of the latch 208 via its tail 219. Thus if the door handle, not shown, is actuated, then at the same time the extended bolt 209 and the latch 208 are moved into their position in which they are retracted into the main lock box 202 (FIG. 18). The main lock box 202 shown in FIG. 17 thus has a full panic function.

Figure 19:
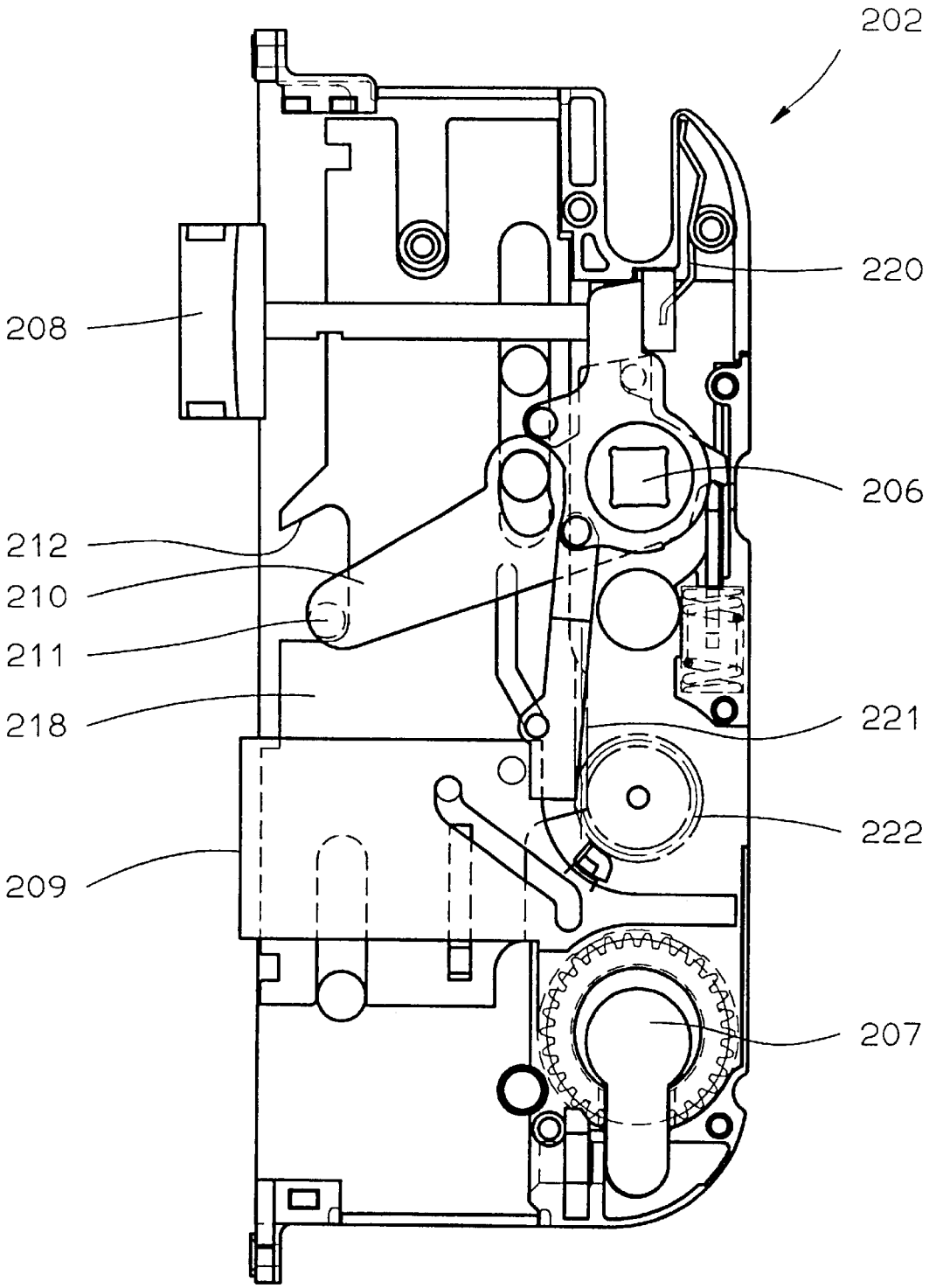
FIG. 19 shows the main lock box of FIG. 17 in a position of repose with the latch in the latching position.

If the door handle is let go, then the latch 208 is pushed outward via the latch projection spring 220 into its latching position, as shown in FIG. 19, while conversely the bolt 209 remains in its retracted position, since the control plate 218 remains in the upward-displaced position and only the journal 211 lifts away from the control cam 212 and assumes its position of repose shown in FIG. 17.

In addition to the control plate 218, the main lock box 202 may as in the exemplary embodiment shown in FIG. 11 be provided with a further control plate 220, which extends parallel to the control plate 218. This second control plate is then likewise connected to the change lever 215 via a connecting rod (not shown). Second drive rods, corresponding to the exemplary embodiment of FIG. 11, may be coupled to the second control plate.

On the side remote from the faceplate 204, the control plate 218 is provided with toothing 221, which meshes with a gear wheel 222 of the planetary gear, shown merely in suggested fashion. In other words, if the gear wheel 22 rotates, via the lock cylinder 207 and the planetary gear, then the control plate 218 is displaced via the toothing 221 meshing with the gear wheel 222. In the same way, if the control plate 218 is displaced, the gear wheel 222 meshing with the toothing 221 and via this gear wheel the planetary gear and thus the lock cylinder 217 are restored to their previous position.

What is claimed is:

1. A locking device for a door, window or the like having a frame and edge plate in the frame, comprising:

a main lock box;

at least one supplementary lock box; and at least one drive rod connecting said at least one supplementary lock box to said main lock box, wherein:

said main lock box includes a latch freely displaceable between a latching position and a retracted position, and each supplementary lock box includes a latch bolt freely displaceable between a latching position and a locking position, and displacement means for displacing said latch bolt past its latching position into its locking position, the displacement of said latch of said main lock box and said latch bolt of each supplementary lock box is similarly directed in the direction of an associated edge plate in the door frame, the window frame or the like structure, each said supplementary lock box further includes a blocking element, and said latch bolt is retained in its latching position by said blocking element, and upon closure of the door said blocking element releases said latch bolt, so that said latch bolt assumes its locking position when the door is closed and extends through the associated edge plate in the door frame, the window frame or the like.

2. The locking device of claim 1, wherein said displacement means comprises a spring.

3. The locking device of claim 1, wherein the door defines a pivotal axis, and wherein said blocking element is supported pivotably in said latch bolt in a plane normal to the pivot axis of the door.

4. The locking device of claim 1, wherein each said supplementary lock box further includes a spring-loaded lever, wherein said blocking element is forced in a projection direction toward the locking position via said spring-loaded lever.

5. The locking device of claim 1, wherein said latch bolt is forced into the latching and locking position via said blocking element.

6. The locking device of claim 1, wherein said at least one drive rod comprises a first drive rod and a second drive rod, and wherein said latch bolt of each supplementary lock box can be moved from its latching position into its locking position via said first drive rod.

7. The locking device of claim 6, wherein said latch bolt of each said supplementary lock box is placed into a retracted position from a latching position by said second drive rod.

8. The locking device of claim 1, wherein said at least one drive rod comprises a first drive rod, and wherein each said latch bolt can be locked and retracted into a latching position by said first drive rod.

9. The locking device of claim 7, wherein said main lock box further includes a control plate and a change lever, and wherein said second drive rod is drivable by said control plate which is located over said change lever.

10. The locking device of claim 7, wherein each said latch bolt is retractable in latching position by said second drive rod.

11. The locking device of claim 7, wherein said main lock box further includes a lock cylinder, and wherein said first drive rod is operatively connected to said lock cylinder.

12. The locking device of claim 7, wherein said main lock box further includes a change lever, a handle follower and a lock cylinder, and wherein said second drive rod is operatively connected by said change lever to said handle follower and lock cylinder.

13. The locking device of claim 7, wherein said latch bolt is retracted upon closure of the door and is out of operative communication with any one of said drive rods.

14. The locking device of claim 1, wherein said main lock box has one of a latch bolt; a bolt; a bolt and latch; and a latch.

15. A locking device for a door, window or the like having a frame and edge plate in the frame, comprising:

a main lock box;

at least one supplementary lock box; and at least one drive rod connecting said at least one supplementary lock box to said main lock box, wherein:

said main lock box includes a latch freely displaceable between a latching position and a retracted position, and each supplementary lock box includes a latch bolt freely displaceable between a latching position and a locking position, and displacement means for displacing said latch bolt past its latching position into its locking position, the displacement of said latch of said main lock box and said latch bolt of each supplementary lock box is similarly directed in the direction of an associated edge plate in the door frame, the window frame or the like structure, each said supplementary lock box further includes a latch restoring lever, and said latch bolt includes a contact incline and a latch tail, and wherein, on its side opposite the contact incline and in the region of the latch tail said latch bolt has a protrusion which is engaged by said latch restoring lever.

16. The locking device of claim 2, wherein said latch restoring lever engages said at least one drive rod such that on actuation of said at least one drive rod said latch restoring lever is carried along by said at least one drive rod such that said latch bolt can be moved in a reverse direction into the retraction position.

17. The locking device of claim 2, wherein on closure of the door and retraction of said latch bolt, the latch restoring lever is pivoted by said latch bolt and decoupled from said at least one drive rod.

18. The locking device of claim 2, wherein said latch restoring lever is pivotable about an axis which extends in a direction at right angles to the displacement of said latch bolt of the respective supplementary lock box.

19. The locking device of claim 2, wherein each said supplementary lock box further includes a latch blocking lever, wherein said latch bolt is engaged by said latch blocking lever, which when the latch bolt has been pushed all the way out of said supplementary lock box locks said latch bolt in its locking position.

20. The locking device of claim 19, wherein said latch blocking lever includes a blocking edge, and in the locking position of said latch bolt engages said latch bolt, or a protrusion of said latch bolt from behind with said latch blocking edge.

21. The locking device of claim 20, wherein each said supplementary lock box further includes a latch blocking lever, and wherein said latch restoring lever has a pawl, which upon actuation of said latch restoring lever via said drive rod lifts said latch blocking lever out of its position that locks said latch bolt and releases said latch bolt for retraction.

22. The locking device of claim 20, wherein said latch blocking lever is supported pivotably about an axis which extends in a direction perpendicular to the displacement of said latch bolt of the respective supplementary lock box.

23. The locking device of claim 20, wherein each said supplementary lock box includes a spring, and wherein said latch blocking lever is connected to said spring which exerts a force directing said latch bolt into its locking position.

* * * * *